US005524880A

United States Patent [19]

Kobayashi

[11] Patent Number: 5,524,880

[45] Date of Patent: Jun. 11, 1996

[54] SET OF IRON GOLF CLUB HEADS HAVING A SHIFTING BACK SURFACE

[75] Inventor: Kenji Kobayashi, Tsubame, Japan

[73] Assignee: K.K. Endo Seisakusho, Japan

[21] Appl. No.: 286,266

[22] Filed: Aug. 5, 1994

[30] Foreign Application Priority Data

Apr. 5, 1994 [JP] Japan ..... 6-067366

[51] Int. Cl.[6] ..... A63B 53/04

[52] U.S. Cl. ..... 473/291; 473/290

[58] Field of Search ..... 273/77 A, 167 J, 273/167 A, 175, 169, 167 F, 167 H, 170, 171, 172, 77 R

[56] References Cited

U.S. PATENT DOCUMENTS

| | | | |
|---|---|---|---|
| 1,642,462 | 9/1927 | Reach | 273/77 A |
| 3,059,926 | 10/1962 | Johnstone | 273/77 A |
| 4,802,672 | 2/1989 | Long | 273/77 A |
| 4,848,747 | 7/1989 | Fujimura et al. | 273/77 A |
| 5,160,136 | 11/1992 | Eger | 273/77 A |
| 5,295,686 | 3/1994 | Lundberg | 273/77 A |

FOREIGN PATENT DOCUMENTS 1-113082 5/1989 Japan .

*Primary Examiner*—William M. Pierce
*Attorney, Agent, or Firm*—Quarles & Brady

[57] ABSTRACT

A set of iron golf club heads for correction of each tendency to hook balls for short irons, and to slice balls for long irons respectively. As the number of the iron golf club head increases, the back of each head body is shifted crosswise away from the neck relative to the face. Thus, as the number of the iron golf club head increases, the center of gravity of each head body is generally shifted crosswise away from the neck as well. Particularly, a position of a middle point M of the face of the 5th iron golf club head is approximately consistent with that of the center of gravity with respect to the lateral direction. Owing to the above position-settings of the center of gravity, balls are given slicing rotation for short irons, while balls are given hooking rotation for long irons, thereby decreasing either a habitual hooking or slicing tendency.

8 Claims, 3 Drawing Sheets

SET OF IRON GOLF CLUB HEADS HAVING A SHIFTING BACK SURFACE

BACKGROUND OF THE INVENTION (a) Field of the Invention

The present invention relates to a set of iron golf club heads.

(b) Description of Prior Art

A set of iron golf club heads is, for instance, a set of a plurality of golf club heads from 1st iron (so-called long iron) to 9th iron (so-called short iron) including pitching and sand wedges. Each structural factor of such iron golf club head depends on each setting. First, the larger the number of a golf club head is, the shorter a shaft and the larger a loft angle becomes, said loft angle being defined as an angle of a face relative to a vertical surface. Secondly, the larger the number thereof is, the larger a lie angle becomes as well, said lie angle being definied as an angle of a shaft relative to a horizontal plane. Further, as a result of the above settings, the larger the number is, the lower the center of gravity of each golf club head becomes in general.

According to the prior set of iron golf club heads, however, each position of the center of gravity relative to each face and neck is generally invariable crosswise. FIG. 4 illustrates one representative of prior iron golf club heads, in which 1 designates a head body having a face 2 at its front surface, while 3 designates a back, 4 a heel at one of the both sides of the head body 1, 5 a toe at the other thereof, the heel 4 being provided with a neck 7 extending therefrom for connecting a shaft 6 thereto. Further, MO designates a middle point of the face 2 with respect to its transversal length, which is to be target for hitting balls, while GO designates the center of gravity of the head body 1. The middle point MO and the center of gravity GO are approximately on the same normal line of the face 2 regardless of the number of the iron golf club head. However, such prior set of iron golf club heads is apt to cause the hooking of balls for short irons, while the slicing of balls for long irons.

Whereas, Japanese Patent Laid-Open No.1-113082 discloses another prior art such that the larger the number of an iron golf club head becomes, the less so-called displacement becomes to equalize the moment of inertia around each shaft regardless of the number of an iron golf club head, said displacement being defined as a distance measured crosswise between the intersection of the central axis of a shaft with a horizontal ground plane of a head body and the center of gravity thereof. With such structures, however, both tendencies to hook balls for short irons and to slice balls for long irons will rather increase.

SUMMARY OF THE INVENTION

To eliminate the above-mentioned problems, it is, therefore, a main object of the present invention to provide a set of iron golf club heads which can correct the tendencies to hook balls for short irons and to slice balls for long irons.

It is another object of the present invention to provide a set of iron golf club heads, in which the setting for the above correction can be easily carried out in fabrication thereof.

According to a major feature of the present invention, a set of iron golf club heads consisting of a plurality of iron golf club heads, each of which comprising: a head body having a face at its front; a heel at its one side; a toe at its other side; a neck extending obliquely upward from the heel; a shaft which is shortened as the number of an iron golf club head increases, said head body having the center of gravity which generally becomes distant from the neck side as the number of the iron golf club head increases.

BRIEF DESCRIPTION OF THE DRAWINGS

Other objects, features and advantages of the invention will be apparent to those skilled in the art from the following description of the preferred embodiments of the invention, wherein reference is made to the accompanying drawings, of which.

DETAILED DESCRIPTION OF THE PREFERRED EMBODIMENTS

Hereinafter is described an embodiment of the present invention with reference to FIGS. 1 to 3. To each reference number for designating each part of iron golf club head is suitably attached a small letter corresponding to the number of each iron golf club head.

Figure 3:
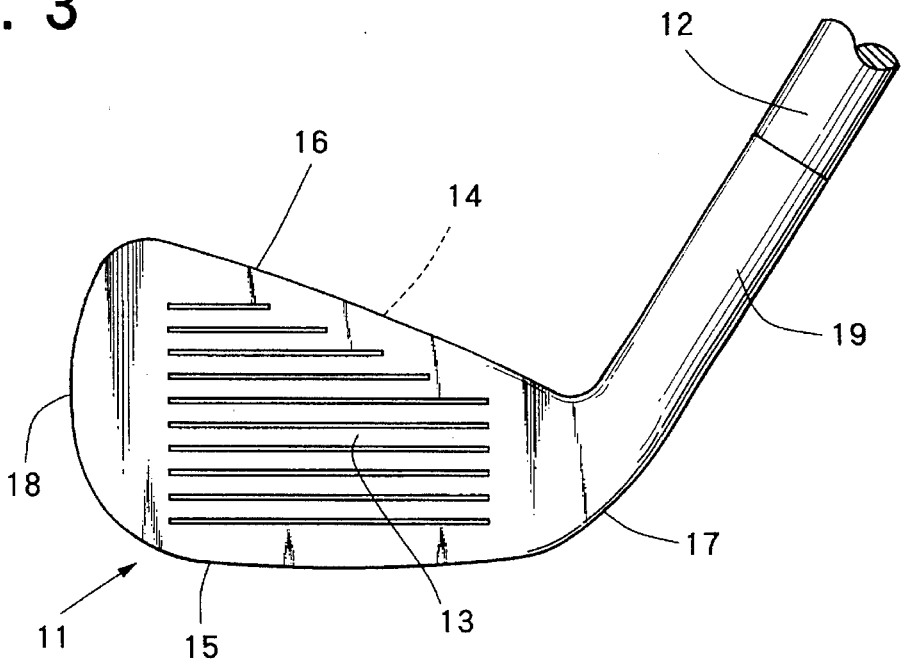
FIG. 3 is a front view showing an embodiment of a set of iron golf club heads of the present invention.
Figure 4:
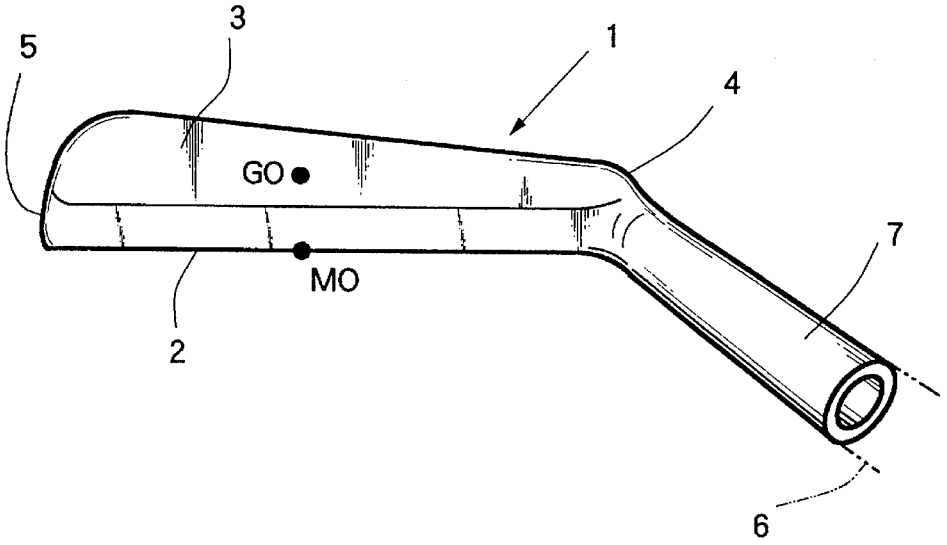
FIG. 4 is a plan view showing one example of a prior iron golf club head.

Referring to FIG. 3, an iron golf club head of the invention comprises a head body 11 and a shaft 12 secured thereto. The head body 11 has a face 13 at its front, a back 14 at its back, a sole 15 at its lower side, a top 16 at its upper side, a heel 17 at its side, a toe 18 at its other side closer to the shaft 12 and a neck 19 formed at the heel 17 side for connecting the shaft 12 thereto respectively. The head body 11 is integrally formed by means of forging, casting, cutting work or the like, which is made of metallic material such as titanium alloy, pure titanium, stainless steel or iron steel or the like. In a preferred form of a set of iron golf club heads of the invention, the larger the number of the iron golf club head is, the shorter the shaft 12 and the larger the loft and lie angles become respectively.

Figure 1A:
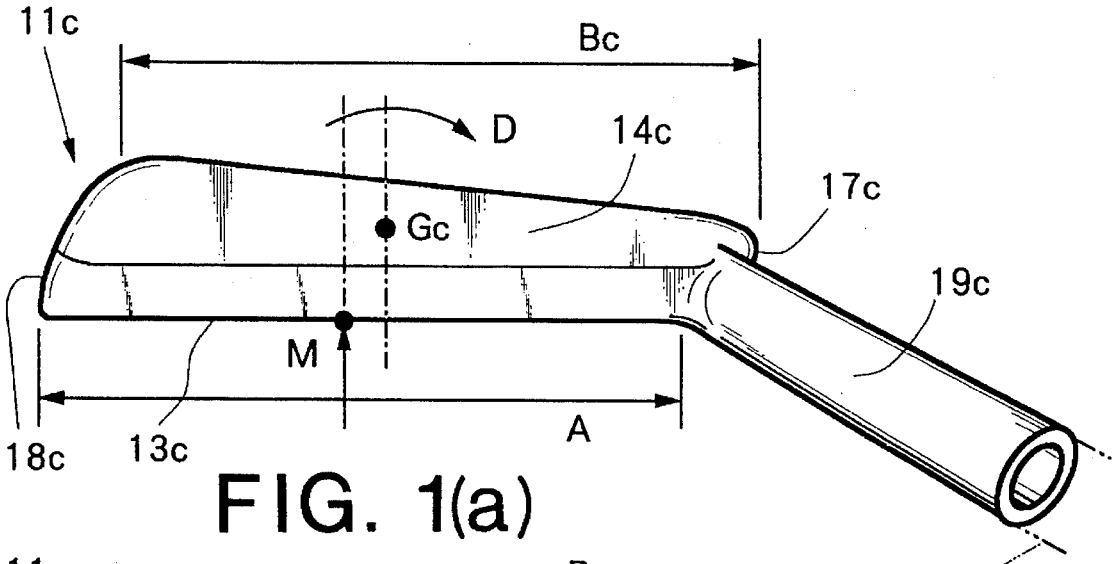
FIG. 1 is a plan view showing an embodiment of a set of iron golf club heads of the invention.
Figure 1B:
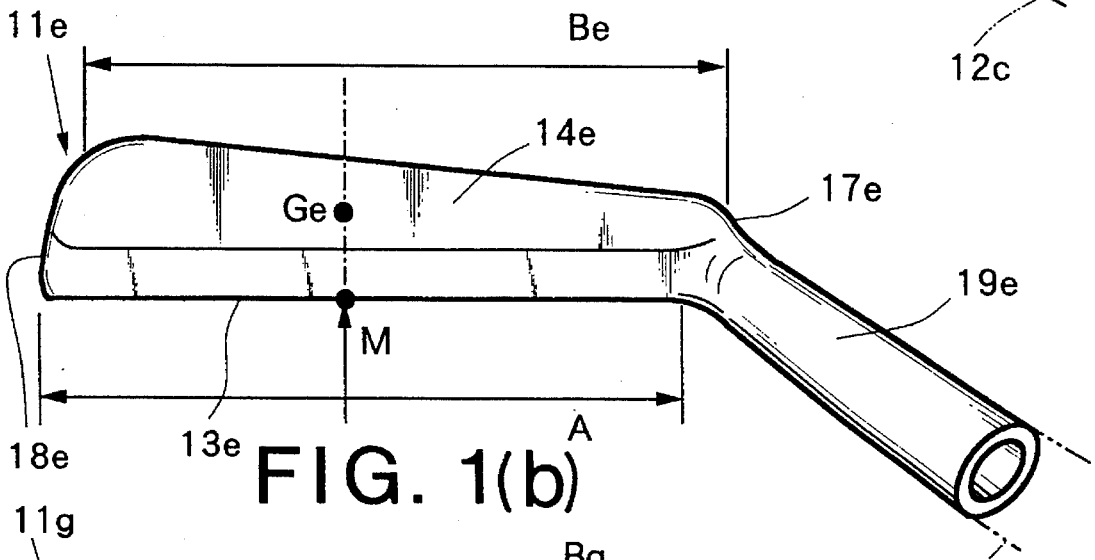
Figure 1C:
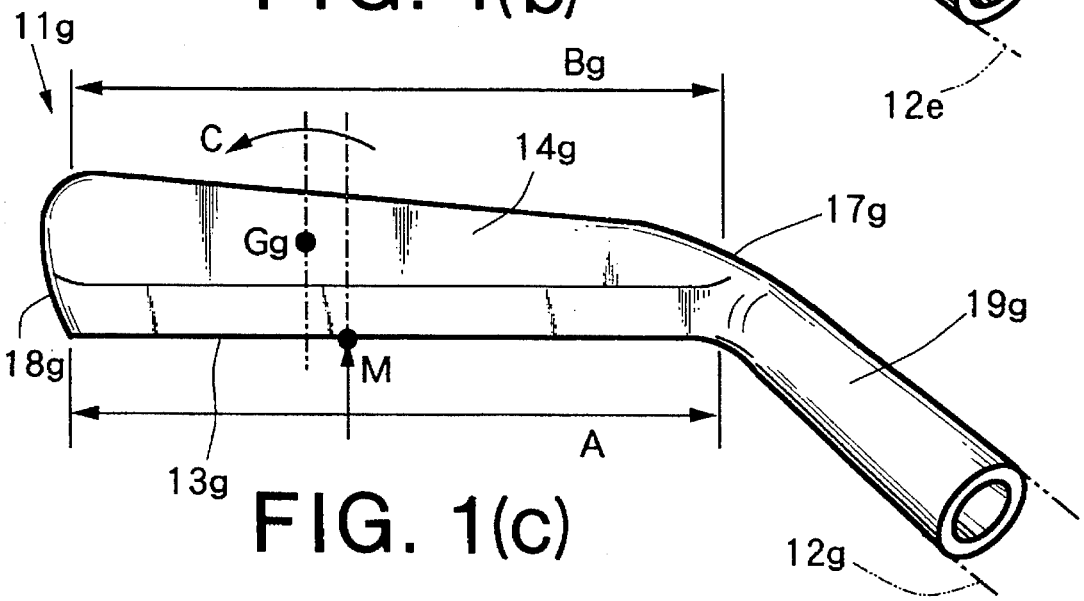
Figure 2:
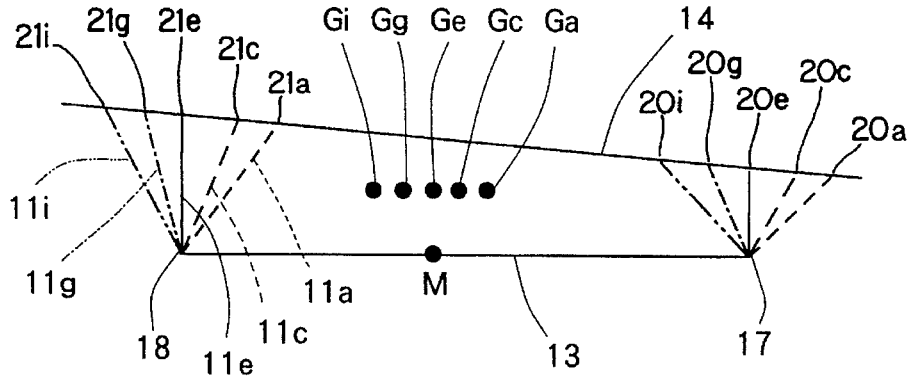
FIG. 2 is an explanatory plan view showing a variation of each configuration of an embodiment of a set of iron golf club heads of the invention.

Referring to FIGS. 1 and 2, each head body 11*a*, 11*c*, 11*e*, 11*g* and 11*i* has each face 13, 13*c*, 13*e* and 13*g*, each of which having approximately the same positional relationship with each neck 19*c*, 19*e* and 19*g* as seen from its transverse direction, irrespective of the number thereof, while each face 13, 13*c*, 13*e* and 13*g* has nearly a constant transversal length A. In addition, there is provided a common reference mark M designating a middle point in the transversal length of each face 13, 13*c*, 13*e* and 13*g*.

Whereas, each head body 11*a*, 11*c*, 11*e*, 11*g* and 11*i* has each back 14, 14*c*,14*e* and 14*g* shifting crosswise away from each neck 19*c*,19*e*,19*g* relative to each face 13, 13*c*,13*e*,13*g* as the number thereof increases. Thus, each center of gravity Ga,Gc,Ge,Gf,Gi of the head body 11*a*, 11*c*,11*e*,11*g*, 11*i* generally displaces crosswise away from each neck 19*c*,19*e*, 19*g* side relative to each face 13, 13*c*,13*e*,13*g* as the number thereof increases.

Particularly referring to FIG. 2, there is provided a schematic plan view of each head body 11*a*, 11*c*,11*e*, 11*g*, 11*i* corresponding to 1st, 3rd, 5th, 7th and 9th iron golf club head. As can be seen from FIG. 2 and FIG. 1(*b*), 5th iron or so-called middle iron has the middle point M of which the position is nearly consistent with that of the center of gravity Ge of the head body 11*e* with respect to the transversal length. Along the back of each club head 11*a*, 11*c*, 11*e*, 11*g*, 11*i*, a junction is formed with the heel 17 at a heel end 20*a*, 20*c*, 20*e*, 20*g*, 20*i* and with the toe 18 at a toe end 21*a*, 21*c*, 21*e*, 21*g*, 21*i*, respectively. The length between each of the heel ends and the toe ends defines a back segment.

Incidentally, each transversal length Bc,Be,Bg of the back 14*c*,14*e*,14*g* may be preferably constant regardless of the number thereof, but may be suitably modified.

Hereinafter is described an action of the above-described structures.

Typically, the middle points M of the faces 13,13*c*,13*e* and 13*g* are to be targets for hitting balls. Accordingly, the middle points M of the faces 13,13*c*,13*e* and 13*g* are assumed hereinbelow to be the hitting targets.

In accordance with a set of iron golf club heads of the present invention, the larger the number thereof becomes, the farther each center of gravity of each head body of 11,11*a*,11*c*,11*g*,11*i* is shifted crosswise away from each neck 19,19*c*,19*e*,19*g* side. Accordingly, each center of gravity Ga,Gc,Ge,Gg,Gi is separated from each neck 19,19*c*,19*e*, 19*g* side with respect to the common middle ponts M.

In FIG. 1(*b*) showing the 5th iron of the invention, the position of the hitting target M is approximately consistent with that of the center of gravity Ge relative to its transversal length. Accordingly, in the case of the 6th or above short irons, as can be seen from FIG. 1(*c*), each position of the center of gravity of 6th or above short irons is displaced toward the opposite side relative to the neck, thus generating a tendency to rotate the toe of the head body toward the direction C or anti-clockwise. Consequently, balls are given slicing rotations. In this case, the larger the number of the golf club head becomes, the more tendency to rotate the head body in the direction C will be generated.

Whereas, as shown in FIG. 1(*a*), in the case of the 4th or below irons, each position of the center of gravity of the 4th or below long irons is displaced toward the neck, thus generating a tendency to rotate the toe of each head body toward the direction D or clockwise. Consequently, hit balls are given hooking rotations. The less the number of the golf club head becomes, the more tendency to rotate the head body in the direction D will be generated.

With the structure thus far described, hooking tendencies generally associated with the prior short irons can be corrected. Namely, in accordance with an embodiment of the short irons of the present invention, balls are given slicing rotations to correct player's habitual tendency to hook the balls, thus enabling the traveling of the balls as straight as expected. On the other hand, slicing tendencies generally associated with the prior long irons can be corrected. Namely, in accordance with an embodiment of the long irons of the present invention, balls are given hooking rotations to correct player's habitual tendency to slice the balls, thus enabling the traveling of the balls as straight as expected.

To attain the above-mentioned correction, the 5th iron is preferably formed such that the position of the middle point M of the face 13*e* is approximately consistent with that of the center of gravity Ge of the head body 11*e*. For long irons, the centers of gravity Ga,Gc are preferably shifted toward the heels 17,17*c* relative to the middle points M of the faces 13,13*c*, while for short irons, the centers of gravity Gg,Gi are preferably shifted toward the toes 18,18*g* relative to the middle points M of the faces 13,13*g*. Accordingly, this prevents golf balls from hooking and slicing to obtain the excellent traveling directions thereof by selectively using each number of iron golf club head.

Whereas, it would also be possible to provide each position of the center of gravity corresponding to each number of iron golf club head, for example, by securing each balance weight made of denser material to each head body and adjusting the securing position. However, in accordance with the aforesaid embodiment, the faces 13,13*c*,13*e* and 13*g* of the head bodies are uniformly provided, while the backs 14,14*c*,14*e* and 14*g* thereof are shifted crosswise as a whole. In other words, the positon of the center of gravity for each number of iron golf club head can be set without the separate balance weight, but only by suitably choosing each configuration of the head body 11,11*a*,11*c*,11*e*,11*g* and 11*i*. As a result, the head bodies 11,11*a*,11*c*,11*e*,11*g* and 11*i* can be manufactured easier than prior sets of golf club heads.

Incidentally, the present invention should not be limited to the aforesaid embodiment, but may be modified within a scope of the invention. For example, unlike the disclosed head body 11 of which the thickness generally increase from the heel 17 to the toe 18, the thickness of the head body may be approximately equalized from the heel to the toe. Further, instead of shifting the back 14 of the head body 11 crosswise, the thickness from front to back of the head body can be adjusted for suitable position-setting of the center of gravity corresponding to the number of iron golf club head, although the manner cannot be so clearly distinguished from the above-described. Furthermore, the present invention can be also applied to iron golf club heads having denser balance weights secured thereto.

What is claimed:

1. A set of iron golf club heads including 1st to 9th iron golf club heads, each of which comprising:

a head body having a face at its front, a heel at its one side, a toe at its other side, a neck extending from the heel and a back on the opposite side from the face, said back adjoining said heel at a heel end and adjoining said toe at a toe end, a back line segment defined between said heel end and said toe end and extending along a back line;

a shaft connected through said neck to said heel of said head body, which is shortened as the number of each iron golf club head increases, said back line segment of said head body generally shifting crosswise away from said neck along said back line as the number of the iron golf club head increases, so that displacement progressively increases from long irons to short irons.

2. A set of iron golf club heads according to claim 1 wherein the center of gravity of said head body generally shifts crosswise away from said neck as the number of the iron golf club head increases, so that displacement progressively increases from long irons to short irons.

3. A set of iron golf club heads according to claim 1, wherein a position of a middle point of the face of a 5th iron golf club head is approximately consistent with that of the center of gravity of its head body with respect to a heel to toe direction.

4. A set of iron golf club heads according to claim 1, wherein said head body is formed of titanium alloy or pure titanium.

5. A set of iron golf club heads according to claim 1, wherein said head body is formed of stainless steel.

6. A set of iron golf club heads according to claim 1, wherein a position of a middle point of the face of a 5th iron golf club head is approximately consistent with that of the center of gravity of the head body with respect to a heel to toe direction.

7. A set of iron golf club heads according to claim 1, wherein regardless of the number of the iron golf club head, each face of the iron golf club head has approximately a constant positional relationship with its neck with respect to a heel to toe direction.

8. A set of iron golf club heads according to claim 1, wherein said head body is integrally provided.

* * * * *